United States Patent [19]

Girardin et al.

[11] 4,353,504

[45] Oct. 12, 1982

[54] HIGH PRESSURE SNOW GUN

[75] Inventors: Pierre Girardin, St Herblain; Max Duplan, Champagne au Mont d'Or, both of France

[73] Assignee: Le Froid Industriel York S.A., Paris, France

[21] Appl. No.: 141,425

[22] Filed: Apr. 18, 1980

[30] Foreign Application Priority Data

Apr. 20, 1979 [FR] France ..... 7910437

[51] Int. Cl.[3] ..... F25C 3/04

[52] U.S. Cl. ..... 239/14; 239/402; 239/404; 239/416; 239/417

[58] Field of Search ..... 62/74; 239/2.5, 14, 239/403–405, 413, 416, 417, 417.3

[56] References Cited

U.S. PATENT DOCUMENTS 3,301,485 1/1967 Tropeano et al. ..... 239/2.5

3,774,843 11/1973 Rice ..... 239/14

3,908,903 9/1975 Burns, Jr. ..... 239/2.5

*Primary Examiner*—Andres Kashnikow

*Attorney, Agent, or Firm*—Frost & Jacobs

[57] ABSTRACT

A snow gun for making artificial snow by atomizing a mixture of air and water is disclosed. The snow gun comprises a hollow body, a compressed air supply conduit terminated by an injection nozzle accommodated inside the hollow body and opening at an end into the hollow body. A pressurized water supply conduit opens into a space between the hollow body and the air supply conduit. A mixing chamber for mixing air and water communicates through an inlet port with the interior of the hollow body, the inlet port facing the discharge nozzle of the injection nozzle. The injection nozzle is displaceable longitudinally relative to the inlet port of the mixing chamber for adjusting the water flow passage to the mixing chamber. A needle valve adjusts the cross-sectional area of discharge orifice of the air injection nozzle. The mixing chamber comprises the bore of a main nozzle extending in the continuation of the injection nozzle. A divergent nozzle extends from the discharge end of the bore and opens to the surrounding air.

10 Claims, 3 Drawing Figures

HIGH PRESSURE SNOW GUN

FIELD OF THE INVENTION

The present invention relates to an apparatus known as a snow gun and an installation comprising a plurality of such apparatus arranged in a battery.

The invention relates more particularly to high pressure apparatus adapted to make artificial snow by atomizing an air and water mixture.

BACKGROUND OF THE INVENTION

High pressure apparatus operate by atomizing a mixture of compressed air and water into a mist in low temperature ambient air so that the droplets of water projected at high speed are transformed into ice crystals in contact with the cold air and fall to the ground as snow.

Such apparatus have been disclosed in French Pat. No. 1,337,141 and U.S. Pat. No. 2,676,471. The apparatus disclosed in these patents comprise separate pressurized water and compressed air supplies as well as a discharge nozzle assuring good snow flake distribution as a function of ambient atmospheric conditions. Adjustment is produced by replacing the nozzle or by varying the injected air and water pressures.

Now, for wet temperatures between −3° and 0° C. the amount of air required to transform a given quantity of water into snow is very large, and taking account of the wet temperature variations of the air and the rapidity of said variations, it is not possible with the apparatus disclosed in the aforementioned patents to manually assure a proper adjustment of the air/water mixture in this temperature zone, and this is all the more so because the temperature variations are usually unknown by the operators tending the snow guns.

Moreover, following the experiments carried out by the applicant, it has been found that the temperature of the water used is only responsible to a very smal extent for the total amount of air required for the transformation of one kiloram of water into snow, only the wet temperature of the ambient air has an effect thereon, which is determined as a function of the temperature of dry air and its humidity. Therefore, for each value of the wet temperature of the ambient air, the theoretical minimum value of the total number of cubic meters of air may be calculated for transforming one cubic meter of water into snow, i.e., the theoretical value of the minimum air/water ratio. It is to be noted that the minimum quantity of air required for assuring this transformation is in fact the overall volume of air concerned by this change of state, i.e., not only the amount of compressed primary air which is injected and expanded in the snow gun but also the amount of secondary air drawn at the exit of the snow gun which essentially depends on the shape, size and speed of the jet into the atmosphere.

SUMMARY OF THE INVENTION

An object of the present invention is therefore to provide a snow gun which does not have the drawbacks of the apparatus disclosed in the above-cited patents and which permits both a production of a maximum volume of snow for a minimum volume of injected air and automatic control of the air/water mixture as a function of the wet temperature of the ambient air. Another object of the invention is to reduce the noise level of the operation of the apparatus.

According to the invention there is provided a snow gun for making artificial snow by atomizing a mixture of air and water, said snow gun comprising a hollow body, a compressed air supply conduit or passageway terminated by an air injection nozzle, which is accommodated inside the hollow body and opens at an end into said hollow body, a pressurized water supply conduit or passageway opening into a space between the wall of the hollow body and the air supply conduit or passageway, and a mixing chamber for mixing air and water communicating with the interior of the hollow body through an inlet port, the inlet port being located facing the discharge orifice of the air injection nozzle, said snow gun according to the invention further comprising means for adjusting the air flow and water flow passages into the mixing chamber, said mixing chamber being constituted by an elongated bore of a main nozzle extending in the continuation of the injection nozzle and having a divergent nozzle extending from the discharge end of said bore and opening to the surrounding air.

Preferably, the injection nozzle is longitudinally displaceable with respect to the inlet port of the mixing chamber, the injection nozzle comprising means for adjusting the cross-sectional area of the air discharge orifice. The adjusting means may comprise a needle valve incorporated inside the air supply conduit and the air discharge orifice of the injection nozzle is preferably convergent-divergent.

The snow gun according to the invention is designed so that the air and water jets are set into rotational motion about one another at the inlet of the mixing chamber the bore of which is preferably provided with grooves or ramps for intermixing the mixture.

The snow guns according to the invention may be grouped in a battery supplied with air at substantially constant pressure by a source of compressed air, the battery being equipped with automatic control means for adjusting the water flow rate of each snow gun as a function of the wet temperature of the ambient air.

The invention will now be described in greater detail with reference to particular embodiments, given by way of example, and represented in the accompanying drawings.

Figure 1:
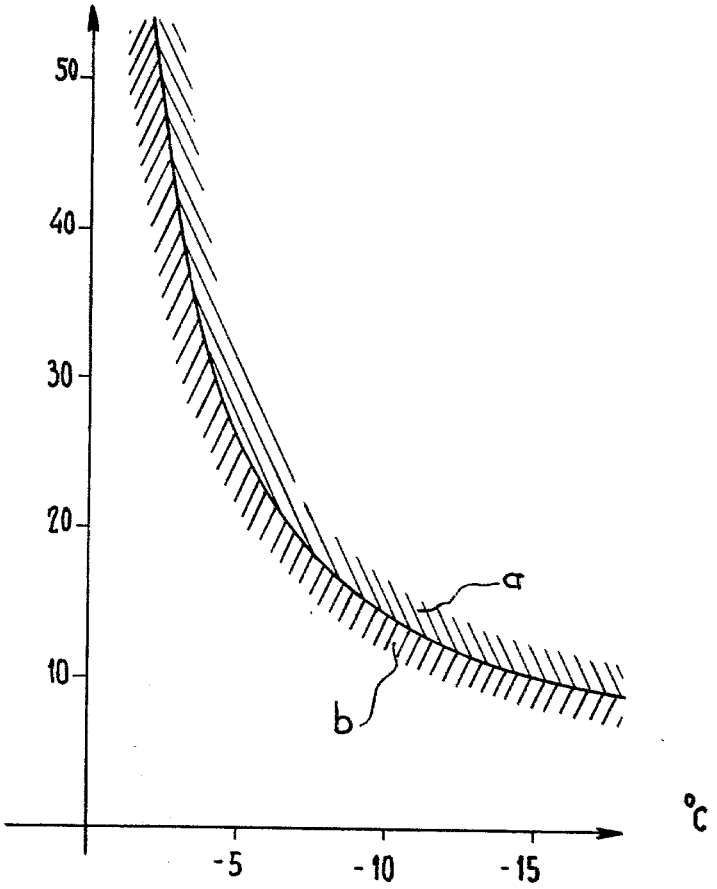
FIG. 1 shows the practical limiting curve measuring the production of snow with the snow gun according to the invention.

As represented in FIG. 1, the measured practical limiting curve of the production of snow with a snow gun in accordance with the invention corresponds to an air induction coefficient of 1250. The wet temperatures of air are marked along the abscissae and the minimum ratios measured of the volume of air to volume of water are marked along the ordinate axis, the hatched areas a and b corresponding respectively to the dry snow area and wet snow area.

Between −3° and −10° C., that is to say for a temperature variation of moist air of 7° C., the air/water ratio goes from 40 to 15, i.e., it varies about 3 to 1. The air induction coefficients characterizing these performances only depend upon the geometrical configuration of the elements comprising the snow gun for predetermined air and water pressures, which induction coefficient remains virtually independent of the temperature conditions of the ambient air. In particular, the atomizing nozzle of the snow gun according to the invention must provide a sufficiently fine and uniform atomization over the entire projection surface and jet configuration assuring intense intermixing of the ambient air so as to reach a high induction capacity.

Thus the air discharge nozzle is a supersonic nozzle with a convergent-divergent orifice adapted to the conditions of operation so as to obtain an air discharge pressure substantially equal to the water pressure at the inlet end of the mixing chamber.

The apparatus must, in particular, satisfy the following momentum equation $$M_a v_a + M_e v_e = (M_a + M_e) v_m$$

where $M_a$, $M_e$, $v_a$, $v_e$ and $v_m$ are respectively the masses of air and water and the speeds of air, water and air/water mixture. The apparatus according to the invention must further comprise a mixing chamber having a cross-sectional area complying with the following formula $$S = V_m \times M_m / v_m$$

where $V_m$, $M_m$ and $v_m$ are respectively the specific volume, the mass and the speed of the mixture.

The mixing chamber must be sufficiently long for the compressed air to give up all its energy to the water and the discharge cross-sectional area of the chamber must be such that the static pressure of the jet is substantially equal to the atmospheric pressure, this in order to avoid the breaking up of the jet. All these conditions contribute to the obtention of a jet with maximum speed and fine, homogeneous atomization.

Figure 2:
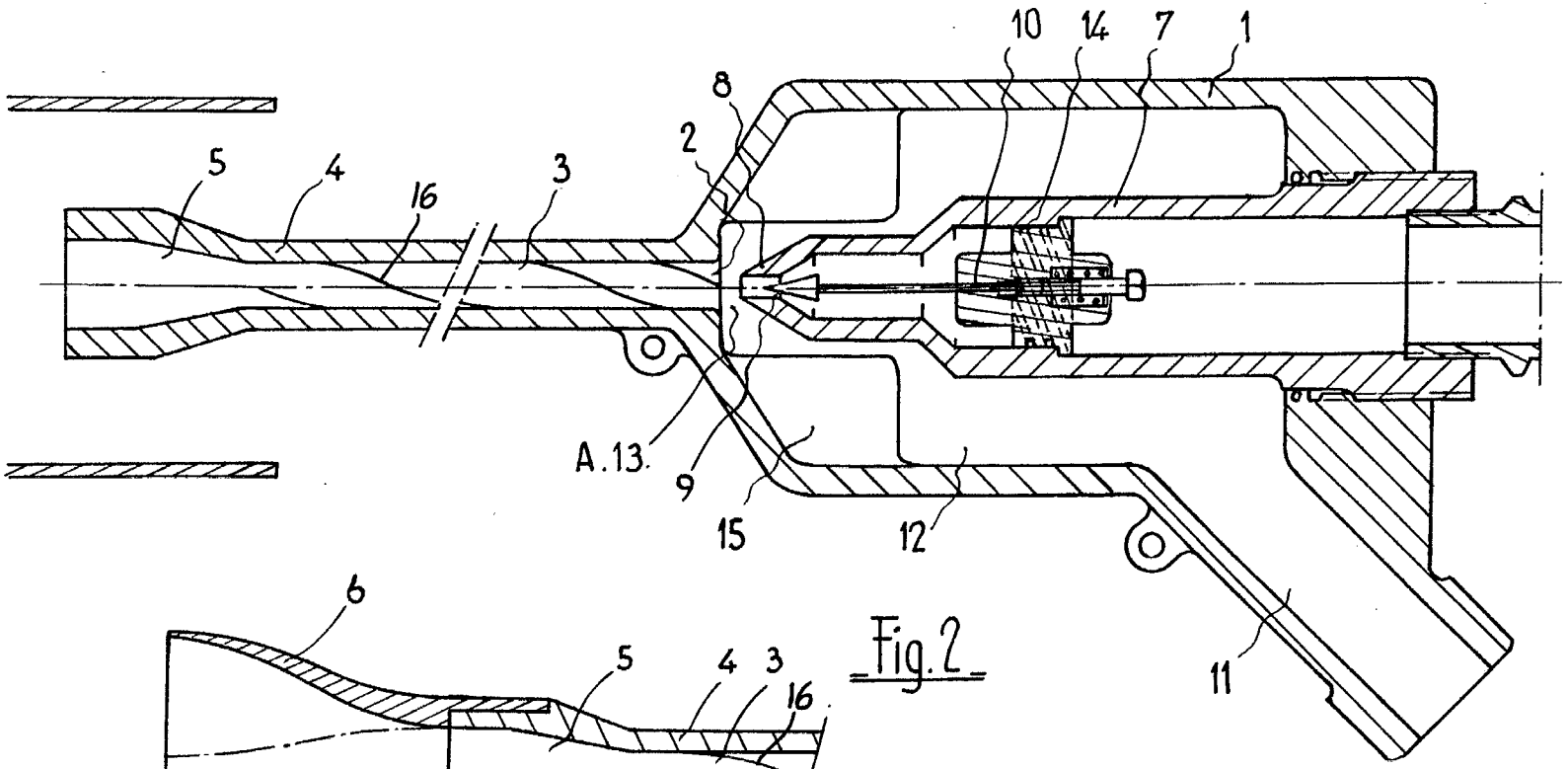
FIG. 2 shows a longitudinal cross-section of a snow gun embodying the invention.
Figure 3:
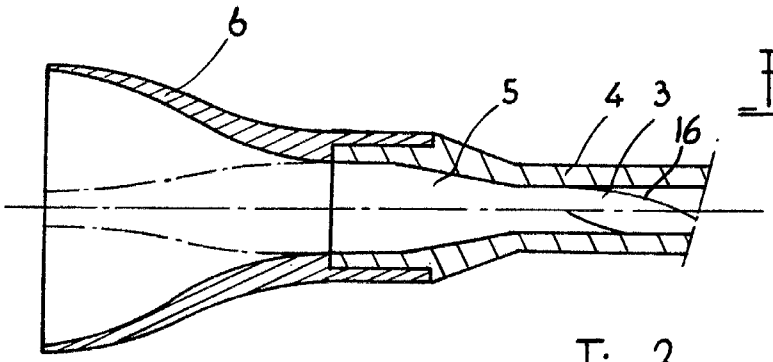
FIG. 3 shows a longitudinal cross-section of the diffusion discharge nozzle or tip adapted to be fitted to the snow gun of FIG. 2.

FIGS. 2 and 3 show a snow gun according to the invention embodying the above-enumerated conditions.

As illustrated in FIG. 2, the snow gun comprises a hollow body 1 having an interior cavity of generally cylindrical configuration provided with a frustoconical wall at one end having at its center an inlet port 2 for a mixing chamber 3 of elongated shape essentially comprising the bore of a main nozzle 4 which is continued at its discharge end by a divergent nozzle 5. The divergent nozzle 5 may optionally be equipped with a diffuser tip or nozzle 6 (see FIG. 3), the tip having a constant cross-sectional area of variable shape, going from a circular inlet shape to a flattened shape at its exit so that the shape of the jet is altered from a round or cylindrical shape to a flat shape.

A compressed air supply conduit or passageway 7 is mounted coaxially of the body 1 of the snow gun and passes through the end wall thereof opposite the frustoconical wall, the supply conduit or passageway 7 having at its end an injection nozzle 8 whose discharge orifice 9 is convergent-divergent. A needle valve 10 accommodated inside the compressed air supply conduit or passageway 7 permits precision adjustment of the outlet cross-sectional area of the discharge orifice 9 of the injection nozzle 8, the cross-sectional area being adjusted upon assembly of the apparatus.

A pressurized water supply conduit or passageway 11 opens at an angle into the annular space 12 included between the hollow body 1 and the central compressed air supply conduit or passageway 7.

The compressed air supply conduit or passageway 7 terminated by the injection nozzle 8 is threadedly engaged into the end wall of the hollow body 1 through which it extends so that the longitudinal position of the conical end of the injection nozzle 8 with respect to the inlet port 2 of the mixing chamber may be adjusted during assembly so as to determine the flow section of the water under pressure into the mixing chamber.

The adjustments of the flow rates of the air and water are adapted to rated operating conditions.

The means for setting the flow into rotation may be incorporated in the body of the snow gun or performed directly therein. Accordingly, there may be provided on the cylindrical contact surface of the needle valve 10 with the supply conduit or passageway 7 helical grooves or screws 14 for the flow of compressed air, the grooves or screws imparting a rotational (or swirling) motion to the air streams. Likewise, the bore of the body 1 of the snow gun may be provided with helical vanes 15 opening in the proximity of the inlet port 2 of the mixing chamber 3, and the bore of the mixing chamber 3 may also be provided with helical grooves or ramps 16 altering the configuration of the jet and assuring a homogeneous mixture of air and water.

The injection nozzle 8 is arranged so that the air pressure at the discharge end is substantially the same as the water pressure in the annular zone or throat 13 located at the inlet port of the mixing chamber 3 and the dimensions of the injection nozzle and the mixing chamber are provided so as to obtain a stable flow thereby reducing the noise level to a minimum.

The automatic control of the air/water mixture as a function of the wet temperature of ambient air is related to the 'snowing' technique. According to the invention the technique seeks uniform snow conditions along the trails and slopes with a minimum of manual operations, by placing automatically controlled low capacity pivotal snow guns at equidistant fixed positions along the entire length of the trail. This arrangement avoids the drawback due to the use of manually adjustable mobile snow guns of greater capacity. The number of snow guns required and therefore the water flow rate must be defined as a function of the conditions of the surface to be covered with snow. This determines, as a function of the average air temperature selected, the amount of air and the power of the compressed air source to be installed.

A constant water flow rate for each snow gun, the flow rate being adjusted for each water off-take, it suffices to vary automatically the air pressure deilvered at each snow gun and therefore the volume of air, to control at each point in time the air/water ratio as a function of the measured wet temperature of the ambient air. This result may be obtained by means of an automatic control means enabling the adjustment of the quality of the snow desired, i.e. dry snow or wet snow. The adjustment is effected by moving the set point of the automatic control means causing the air/water ratio to change by actuating a control button positioned proximate to the air compressors, the only manual assistance being limited to the periodic orientation of the jet after the regular control of the density of the snow fall in the operating area of the jet.

A substantially constant flow of snow is thus obtained whatever the temperature, such an arrangement permitting the consumption of air to be reduced, and therefore energy per snow gun, this arrangement also permitting the number of snow guns to be adapted to the power of the compressed air source.

The control of the air/water ration may also be obtained by varying the water flow rate, the air pressure remaining constant. The snow flow rate of each snow gun may thus be varied and the maximum snow flow possible may be maintained for each of them as a function of the wet temperature of the air.

Finally, a hybrid solution comprising these two possibilities of control may also be envisaged, the choice being made as a function of the location of the installation and its operation.

Although the invention is more particularly applicable to artificial snow-making for trails of ski resorts, it does not exclude other possible applications, namely for fighting fires, and for watering crops or even for spraying antifreeze or insecticides.

The invention is not limited to the embodiment described herein by way of nonlimiting example but is also covers all modifications, alternatives and expedients without departing from the spirit and scope of the invention.

What is claimed is:

1. A snow gun for making artificial snow by atomizing a mixture of air and water, said snow gun comprising a hollow body, a compressed air supply conduit or passageway terminated by an air injection nozzle, said injection nozzle being accommodated inside said hollow body and opening at an end into said hollow body, a pressurized water supply conduit or passageway opening into a space between said hollow body and said air supply conduit or passageway, a mixing chamber for mixing air and water communicating with the interior of said hollow body through an inlet port, said inlet port being located facing a discharge orifice of said injection nozzle, adjustment means for adjusting air flow and water flow passage into said mixing chamber, said mixing chamber being constituted by an elongated bore of a main nozzle extending in the continuation of said injection nozzle, and a divergent nozzle extending from the discharge end of said bore opening into the surrounding air.

2. The snow gun according to claim 1, said means for adjusting including means for displacing said injection nozzle longitudinally relative to said inlet port of said mixing chamber for adjusting the water flow passage into said mixing chamber.

3. The snow gun according to claim 1 or 2, wherein said adjustment means further comprises means for adjusting the cross-sectional area of said air discharge orifice of said injection nozzle.

4. The snow gun according to claim 3, wherein said means for adjusting the cross-sectional area of said air discharge orifice essentially comprises a needle valve incorporated inside said air supply conduit or passageway.

5. The snow gun according to claim 1, wherein said injection nozzle has a discharge orifice of convergent-divergent configuration.

6. The snow gun according to claim 5, wherein said needle valve comprises helical grooves for the flow of air.

7. The snow gun according to claim 1, further comprising helical vanes inside said hollow body opening proximate to said inlet port of said mixing chamber for setting the flow of pressurized water into rotational motion.

8. The snow gun according to claim 1, wherein said bore of said mixing chamber comprises means for intermixing the mixture of air and water therein.

9. The snow gun according to claim 8, wherein said means for intermixing comprise grooves or ramps.

10. The snow gun according to claim 1, wherein said main nozzle is extended by a diffusion tip or nozzle of constant cross-sectional area equal to the cross-sectional area of the end section of said divergent nozzle.

* * * * *